US008285175B2

(12) United States Patent
Choi et al.

(10) Patent No.: US 8,285,175 B2
(45) Date of Patent: Oct. 9, 2012

(54) IMAGE FORMING APPARATUS AND TRANSFER DEVICE THEREOF

(75) Inventors: Hwi Kyu Choi, Anyang-Si (KR); Moon Bae Park, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 524 days.

(21) Appl. No.: 12/541,619

(22) Filed: Aug. 14, 2009

(65) Prior Publication Data

US 2010/0158566 A1 Jun. 24, 2010

(30) Foreign Application Priority Data

Dec. 24, 2008 (KR) ..... 10-2008-0133653

(51) Int. Cl.
*G03G 15/08* (2006.01)
*G03G 15/01* (2006.01)

(52) U.S. Cl. ..... 399/121; 399/299

(58) Field of Classification Search ..... 399/121, 399/299, 300, 313
See application file for complete search history.

(56) References Cited

U.S. PATENT DOCUMENTS

| | | | | |
|---|---|---|---|---|
| 7,164,877 | B2 * | 1/2007 | Murakami et al. | 399/121 |
| 7,400,852 | B2 * | 7/2008 | Furukawa | 399/299 X |
| 2007/0116496 | A1 * | 5/2007 | Morimoto et al. | 399/299 |
| 2007/0116497 | A1 * | 5/2007 | Yamazaki | 399/299 |
| 2008/0050148 | A1 * | 2/2008 | Zensai | 399/121 |
| 2008/0193173 | A1 * | 8/2008 | Meguro et al. | 399/299 X |

FOREIGN PATENT DOCUMENTS

| | | |
|---|---|---|
| JP | 11-072989 | 3/1999 |
| JP | 2002-139877 | 5/2002 |
| KR | 10-2008-0058671 | 6/2008 |

OTHER PUBLICATIONS

English language abstract of KR 10-2008-0058671, published Jun. 26, 2008.
English language abstract of JP 11-072989, published Mar. 16, 1999.
Machine English language translation of JP 11-072989, published Mar. 16, 1999.
English language abstract of JP 2002-139887, published May 17, 2002.
Machine English language translation of JP 2002-139887, published May 17, 2002.

* cited by examiner

*Primary Examiner* — Sandra Brase
(74) *Attorney, Agent, or Firm* — Staas & Halsey LLP

(57) ABSTRACT

An image forming apparatus and a transfer device disclosed herein are configured to move positions of transfer rollers to perform different modes of printing operation, such as black-and-white and color printing. The image forming apparatus may include a plurality of photosensitive bodies, on each of which an image may be formed, and a plurality of transfer units. Each transfer unit includes a transfer roller arranged to correspond to an associated one of the photosensitive bodies and an elastic member configured to press the transfer roller to the corresponding photosensitive body. The image forming apparatus further includes a slider configured to move along a linear direction. The slider is configured to cause at least one of the transfer rollers of the transfer units move away from the corresponding photosensitive body. The slider may be driven by a drive unit.

18 Claims, 9 Drawing Sheets

IMAGE FORMING APPARATUS AND TRANSFER DEVICE THEREOF

CROSS-REFERENCE TO RELATED APPLICATION(S)

This application claims the benefit of Korean Patent Application No. 2008-0133653, filed on Dec. 24, 2008 in the Korean Intellectual Property Office, the disclosure of which is incorporated herein by reference in its entirety.

TECHNICAL FIELD

The present disclosure relates generally to an image forming apparatus and, more particularly, to an image forming apparatus having a transfer device to transfer an image to a printing medium.

BACKGROUND OF RELATED ART

Image forming apparatuses are devised to form an image on a printing medium. Examples of image forming apparatuses include printers, copiers, facsimiles, the like, and devices combining at least some functions thereof.

In an electro-photographic image forming apparatus, light is irradiated to a photosensitive body charged with a predetermined electric potential to form an electrostatic latent image on the surface thereof, and developer is fed to develop the electrostatic latent image, into a visible image. The visible image, formed on the photosensitive body, is transferred to a printing medium via a transfer device. After being transferred to the printing medium, the image undergoes a fusing operation, and is thereafter discharged out of the image forming apparatus.

A color image forming apparatus may include a plurality of photosensitive bodies, a transfer belt to directly or indirectly transfer an image formed on each photosensitive body to a printing medium and transfer rollers provided to correspond to the respective photosensitive bodies and adapted to support the transfer belt.

During a printing operation, the transfer rollers may be pressed toward the photosensitive bodies. However, according to one or more operation modes implemented by the image forming apparatus, positions of some or all of the transfer rollers may be altered to be spaced apart from the photosensitive bodies. A unit for changing the positions of some or all of the transfer rollers for implementing various operation modes is thus desired.

SUMMARY OF DISCLOSURE

An image forming apparatus may include a plurality of photosensitive bodies; a plurality of transfer units each including a transfer roller configured to correspond to an associated one of the photosensitive bodies and an elastic member configured to press the transfer roller to the corresponding photosensitive body; a slider configured to be linearly movable in a first direction and operating to separate at least one of the transfer rollers of the transfer units from the corresponding photosensitive body; and a drive unit configured to drive the slider.

The plurality of transfer units may include a first transfer unit and a second transfer unit arranged in the first direction. The transfer rollers of the first transfer unit and second transfer unit may be reciprocally movable in a second direction based on movement of the slider.

The plurality of transfer units may further include a third transfer unit that is rotatably arranged at one end of the slider in the first direction and configured to rotate based on movement of the slider.

The image forming apparatus may further include an elastic unit configured to elastically bias the third transfer unit to separate the transfer roller of the third transfer unit from the corresponding photosensitive body. Elastic force applied by the elastic member to the slider may oppose a direction of elastic force applied by the elastic unit to the slider.

The image forming apparatus may further include levers arranged respectively between the slider and the first transfer unit and between the slider and the second transfer unit. The levers may be configured to convert the first directional movement of the slider into the second directional movement of the transfer rollers.

The plurality of transfer units may further include a fourth transfer unit rotatably arranged at the other end of the slider in the first direction.

The drive unit may include a rotating shaft, a first cam mounted to the rotating shaft and configured to press the slider to cause linear movement of the slider, and a second cam mounted to the rotating shaft and configured to press one side of the fourth transfer unit to cause rotation of the fourth transfer unit. The first cam and second cam may be integrally formed.

An image forming apparatus configured to implement a plurality of operating modes may include a plurality of photosensitive bodies; a transfer belt arranged to face toward the plurality of photosensitive bodies; a plurality of transfer units, each including a transfer roller configured to support an inner peripheral surface of the transfer belt at a position corresponding to an associated one of the photosensitive bodies and an elastic member configured to press the transfer roller to the corresponding photosensitive body; a slider provided to be reciprocally movable in a first direction, the slider configured, in a first operating mode, to separate at least one of the transfer rollers from the corresponding photosensitive body via linear movement of the transfer roller in a second direction and configured, in a second operating mode, to press one of the plurality of transfer units to allow the transfer roller of the one of the plurality of the transfer units to press the corresponding photosensitive body; a drive unit configured to drive the slider; and an elastic unit configured to elastically bias the one of the plurality of the transfer units to separate the transfer roller of the one of the plurality of the transfer units from the corresponding photosensitive body.

The elastic member may be a compressible coil spring, and the elastic unit may be a tensile coil spring.

A transfer device to be mounted in an image forming apparatus having first to fourth photosensitive bodies may include: a supporting frame; a transfer belt configured to transfer an image formed on the respective photosensitive bodies to a printing medium; a first transfer unit including a first roller frame supported by the supporting frame, a first transfer roller movably mounted to the first roller frame, and an elastic member configured to press the first transfer roller toward the first photosensitive body; a second transfer unit including a second roller frame supported by the supporting frame, a second transfer roller movably mounted to the second roller frame, and an elastic member configured to press the second transfer roller toward the second photosensitive body; a third transfer unit including a third roller frame rotatably mounted to the supporting frame and a third transfer roller mounted to the third roller frame to correspond to the third photosensitive body; a slider mounted to the supporting frame in a linearly movable manner and configured to move the first transfer roller, second transfer roller and third roller frame; and a drive unit configured to drive the slider.

The transfer device may further include an elastic unit configured to rotate the third roller frame to separate the third transfer roller from the third photosensitive body.

The transfer device may further include levers arranged respectively between the slider and the first transfer roller and between the slider and the second transfer roller, the levers configured to move the first transfer roller and second transfer roller based on movement of the slider.

Elastic force applied by the elastic member to the slider may oppose a direction of elastic force applied by the elastic unit to the slider.

The transfer device may further include a fourth transfer unit including a fourth roller frame rotatably mounted to the supporting frame and a fourth transfer roller mounted to the fourth roller frame to correspond to the fourth photosensitive body.

The drive unit may include a rotating shaft, a first cam mounted to the rotating shaft and configured to press the slider, and a second cam mounted to the rotating shaft and configured to press the fourth roller frame.

The transfer device may further include a guide roller provided between the slider and the supporting frame, the guide roller configured to guide movement of the slider.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
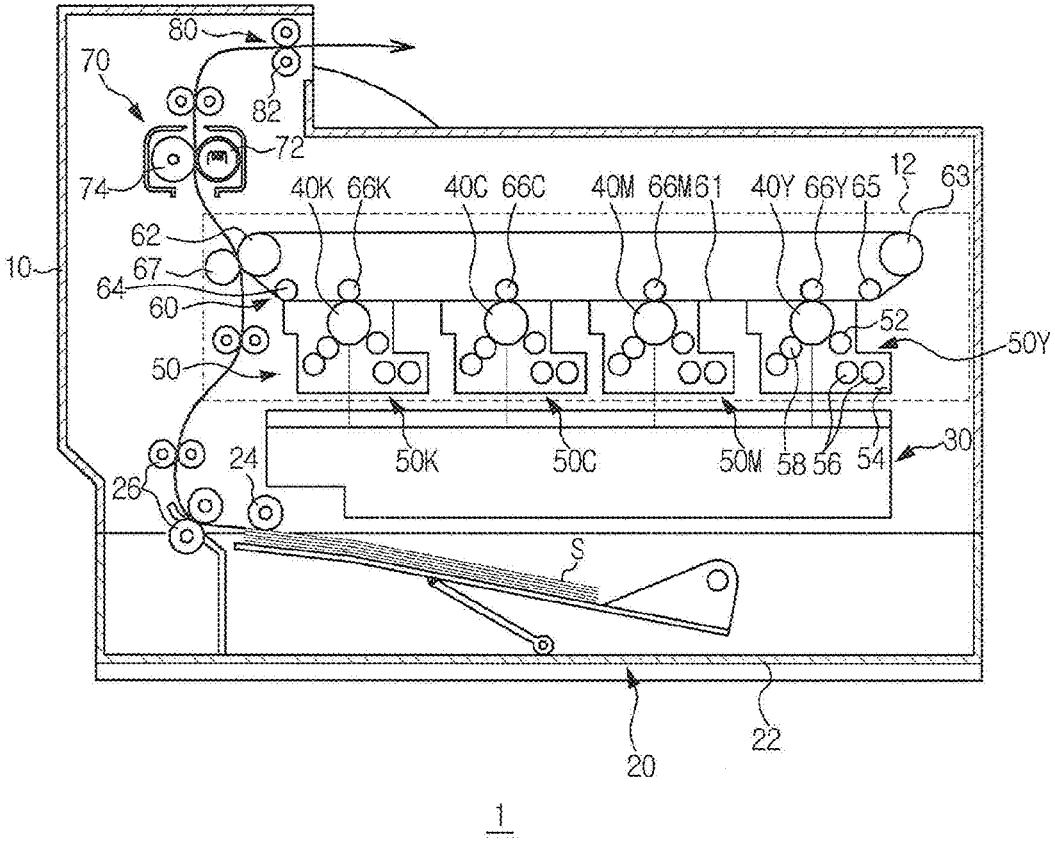
FIG. 1 is a view illustrating a configuration of an image forming apparatus according to an embodiment.

Reference will now be made in detail to the embodiments, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a view illustrating a configuration of an image forming apparatus 1 according to an embodiment.

As shown in FIG. 1, the image forming apparatus 1 may include a body 10, a printing medium supply device 20, a light scanning device 30, a plurality of photosensitive bodies 40Y, 40M, 40C and 40K, a developing device 50, a transfer device 60, a fusing device 70 and a printing medium discharge device 80.

The body 10 may define an exterior appearance of the image forming apparatus 1, and may support a variety of constituent elements installed therein. A body cover 12 may be pivotally rotatably coupled to a front side of the body 10. The body cover 12 may be configured to open or close so as to provide access to one or more elements supported in the body 10. A user may be able to attach or detach a variety of constituent elements within the body 10 by opening the body cover 12.

The printing medium supply device 20 may include a cassette 22 in which printing media S is stored, a pickup roller 24 configured to pick up the printing media S stored in the cassette 22 sheet by sheet and one or more delivery rollers 26 configured to deliver the picked-up printing media S toward the transfer device 60.

The light scanning device 30 may be configured to irradiate light, corresponding to image information, to the photosensitive bodies 40Y, 40M, 40C and 40K, thereby forming electrostatic latent images on surfaces of the respective photosensitive bodies 40Y, 40M, 40C and 40K. In the following description, when it is beneficial to classify the photosensitive bodies, the photosensitive body 40C is referred to as a first photosensitive body, the photosensitive body 40M is referred to as a second photosensitive body, the photosensitive body 40Y is referred to as a third photosensitive body and the photosensitive body 40K is referred to as a fourth photosensitive body.

The developing device 50 may be configured to feed developer to the electrostatic latent images formed on the photosensitive bodies 40Y, 40M, 40C and 40K, thereby forming visible images. The developing device 50 may include four developing units 50Y, 50M, 50C and 50K in which developer of different colors, for example, black developer K, cyan developer C, magenta developer M and yellow developer Y are received respectively. It should be noted however that the image forming apparatus 1 is not limited to the photosensitive bodies 40Y, 40M, 40C and 40K and the developing units 50Y, 50M, 50C and 50K, and the image forming apparatus 1 may include fewer or more photosensitive bodies and/or developing units.

Each of the developing units 50Y, 50M, 50C, or 50K may include a charger 52, a developer storage 54, one or more developer delivery members 56 and a developing member 58. The charger 52 is configured to charge the surface of the corresponding photosensitive body 40Y, 40M, 40C, or 40K, prior to forming the electrostatic latent images. The developer stored in the developer storage 54 may be delivered to the developing member 58 by the developer delivery members 56. The developing member 58 may be configured to feed the developer to the electrostatic latent image formed on the corresponding photosensitive body 40Y, 40M, 40C, or 40K, to enable formation of the visible image.

The transfer device 60 may serve to transfer the visible image, formed on the respective photosensitive bodies 40Y, 40M, 40C and 40K, to the printing medium S. The transfer device 60 may include a transfer belt 61, a driving roller 62, a supporting roller 63, tension rollers 64 and 65, intermediate transfer rollers 66Y, 66M, 66C and 66K and a transfer roller 67.

The transfer belt 61 may be rotatably supported by the driving roller 62 and the supporting roller 63 with the outer peripheral surface of the transfer belt 61 facing the respective photosensitive bodies 40Y, 40M, 40C and 40K. The intermediate transfer rollers 66Y, 66M, 66C and 66K are arranged to correspond to the respective photosensitive bodies 40Y, 40M, 40C and 40K, and may function to support an inner peripheral surface of the transfer belt 61. As noted above, the image forming apparatus 1 may include fewer or more photosensitive bodies, and the respective number of transfer rollers may accordingly be established based upon the number of photosensitive bodies.

During a color printing operation of the image forming apparatus 1, the intermediate transfer rollers 66Y, 66M, 66C and 66K are pressed toward the respective photosensitive bodies 40Y, 40M, 40C and 40K, causing the respective visible images formed on the photosensitive bodies 40Y, 40M, 40C and 40K to be transferred, overlapping one another, to the transfer belt 61. The resulting image on the transfer belt 61 is transferred to the printing medium S supplied from the printing medium supply device 20 while the printing medium S passes between the transfer belt 61 and the transfer roller 67. Those skilled in the art will understand however that the toner images may alternatively be transferred from the photosensitive bodies 40Y, 40M, 40C and 40K directly by, e.g., allowing the printing medium S to be carried by the transfer belt 61 past each of the photosensitive bodies.

During a black-and-white printing operation of the image forming apparatus 1, the transfer roller 66K corresponding to the photosensitive body 40K is pressed toward the photosensitive body 40K while the remaining transfer rollers 66Y, 66M and 66C may be kept spaced apart from the respective photosensitive bodies 40Y, 40M and 40C.

The printing medium S, having passed through the transfer device 60, enters the fusing device 70. The fusing device 70 may include a heating roller 72 and a press roller 74. When the printing medium S with the transferred image passes between the heating roller 72 and the press roller 74, the image may be fixed to the printing medium S under the influence of heat and pressure.

The printing medium S, having passed through the fusing device 70, is guided to the printing medium discharge device 80, and is discharged out of the body 10 by discharge rollers 82.

Figure 2:
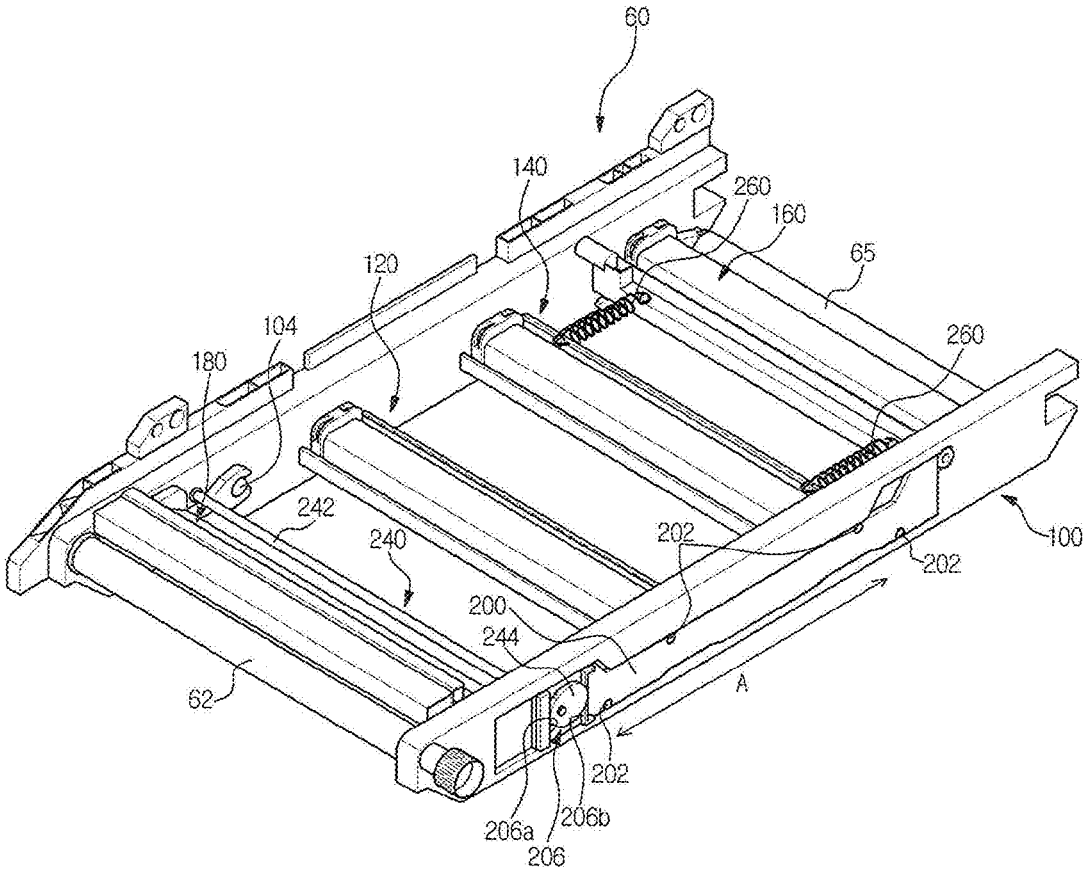
FIG. 2 is a perspective view illustrating a transfer device according to an embodiment.
Figure 3:
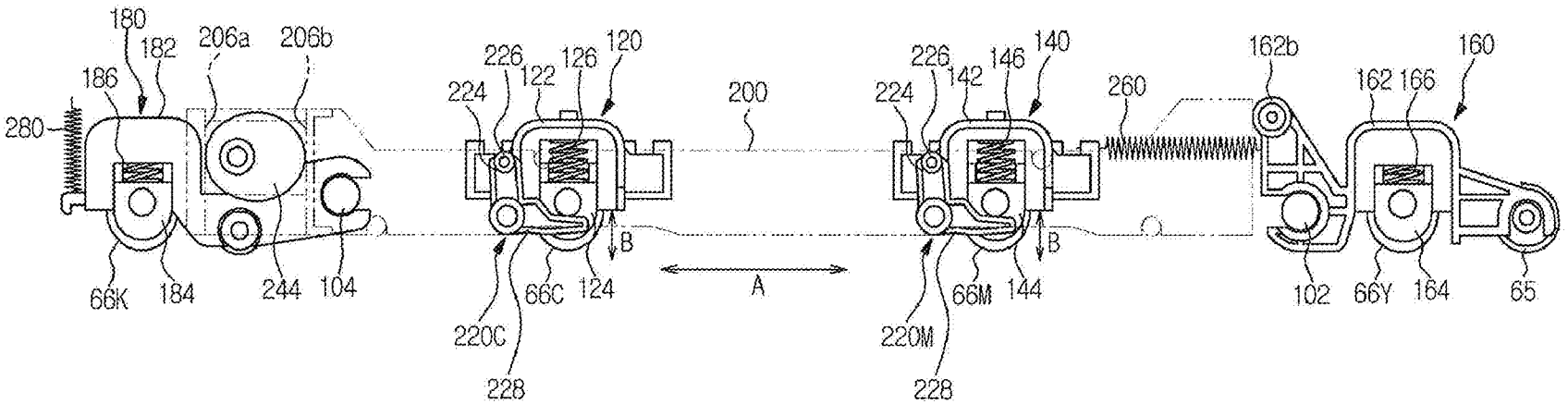
FIG. 3 is a front view illustrating a partial configuration of the transfer device shown in FIG. 2.
Figure 4:
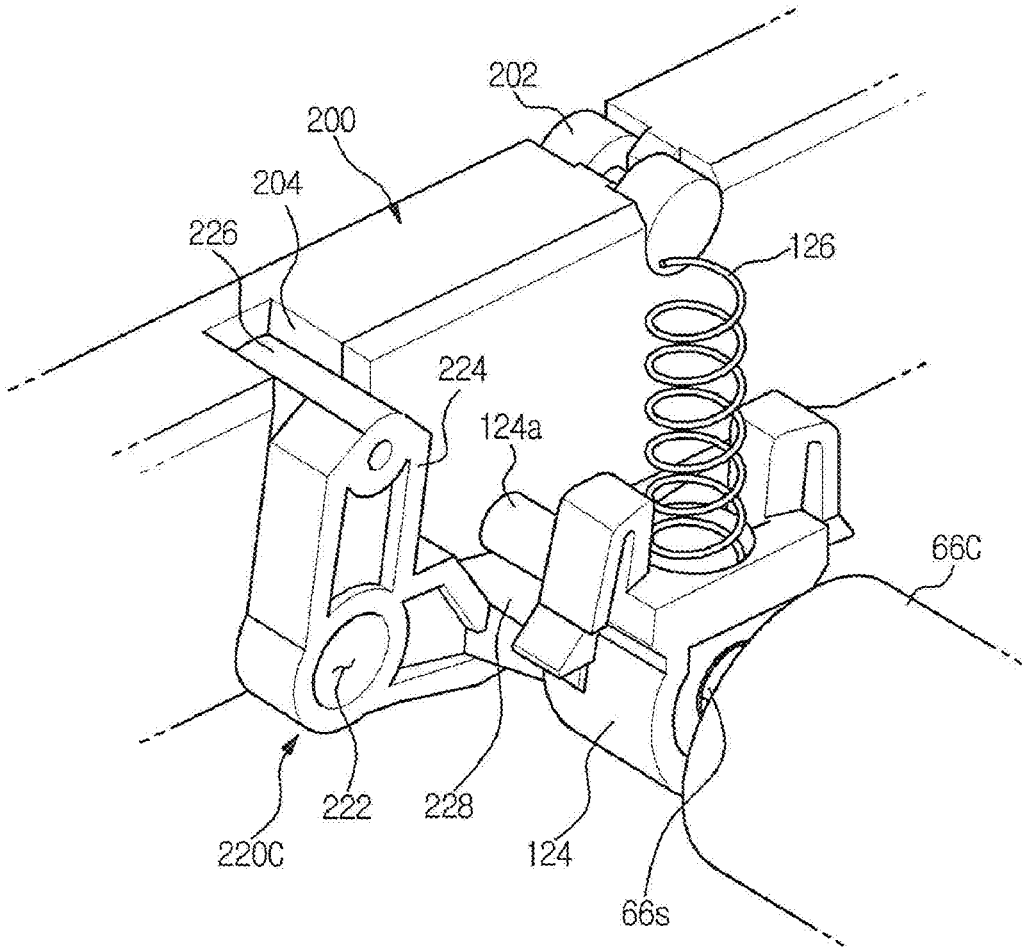
FIG. 4 is a perspective view illustrating a part of a first transfer unit, a slider, and a lever included in the transfer device according to an embodiment.

FIG. 2 is a perspective view illustrating the transfer device 60 according to an embodiment. FIG. 3 is a front view illustrating a partial configuration of the transfer device 60 shown in FIG. 2. FIG. 4 is a perspective view illustrating a part of a first transfer unit, a slider and a lever included in the transfer device 60 according to an embodiment.

As shown in FIGS. 2 to 4, the transfer device 60 according to an embodiment may include, among other things, a supporting frame 100, first to fourth transfer units 120, 140, 160 and 180, sliders 200, levers 220C and 220M and a drive unit 240.

The supporting frame 100 may support a variety of constituent elements of the transfer device 60. For example, according to an embodiment, the driving roller 62 and tension roller 65 may be rotatably mounted to the supporting frame 100. While not shown in FIG. 2, the supporting roller 63 and the tension roller 65 depicted in FIG. 1 may also be supported by the supporting frame 100.

The first to fourth transfer units 120, 140, 160 and 180 may be arranged on the supporting frame 100 to correspond to the respective photosensitive bodies 40Y, 40M, 40C and 40K. For example, the first to fourth transfer units 120, 140, 160 and 180 are arranged in a row along a first direction A. According to an embodiment, the first and second transfer units 120 and 140 may be arranged such that ends thereof face inner surfaces of the sliders 200. The third transfer unit 160 may be arranged at one end of the respective sliders 200 with respect to the first direction A, and the fourth transfer unit 180 may be arranged at the opposite end of the sliders 200.

The first transfer unit 120 may include a first roller frame 122 secured to the supporting frame 100, a first transfer roller 66C mounted to the first roller frame 122, a holder 124 connected to either end of a roller shaft 66*s* of the first transfer roller 66C and an elastic member 126 configured to press the first transfer roller 66C toward the first photosensitive body 40C. The elastic member 126 may be a compressible coil spring, for example.

The holder 124 may be configured to rotatably support an end of the roller shaft 66*s* and may be movably connected to an end of the first roller frame 122. The elastic member 126 may be provided between the holder 124 and the first roller frame 122. One end of the elastic member 126 may be supported by an upper surface of the holder 124 while the other end of the elastic member 126 may be supported by an inner top surface of the first roller frame 122. Thus, the first transfer roller 66C may be supported rotatably and also elastically by the first roller frame 122.

If external force is applied to the holder 124, the first transfer roller 66C is moved away from the first photosensitive body 40C. When the external force acting on the holder 124 is released, the first transfer roller 66C is moved toward the first photosensitive body 40C by elastic force of the elastic member 126, thereby elastically pressing the first photosensitive body 40C with the transfer belt 61 interposed therebetween.

The second transfer unit 140 may have approximately the same support configuration as the first transfer unit 120. That is, for example, the second transfer unit 140 may include a second roller frame 142 secured to the supporting frame 100, a second transfer roller 66M mounted to the second roller frame 142, a holder 144 connected to either end of the second transfer roller 66M and an elastic member 146 configured to press the second transfer roller 66M toward the second photosensitive body 40M.

Similar to the first transfer roller 66C, the second transfer roller 66M is thus elastically and rotatably supported by the second roller frame 142. If external force is applied to the holder 144, the second transfer roller 66M is moved away from the second photosensitive body 40M. When the external force acting on the holder 144 is released, the second transfer roller 66M is moved toward the second photosensitive body 40M by the elastic force of the elastic member 146, thereby elastically pressing the second photosensitive body 40M with the transfer belt 61 interposed therebetween.

Figure 5:
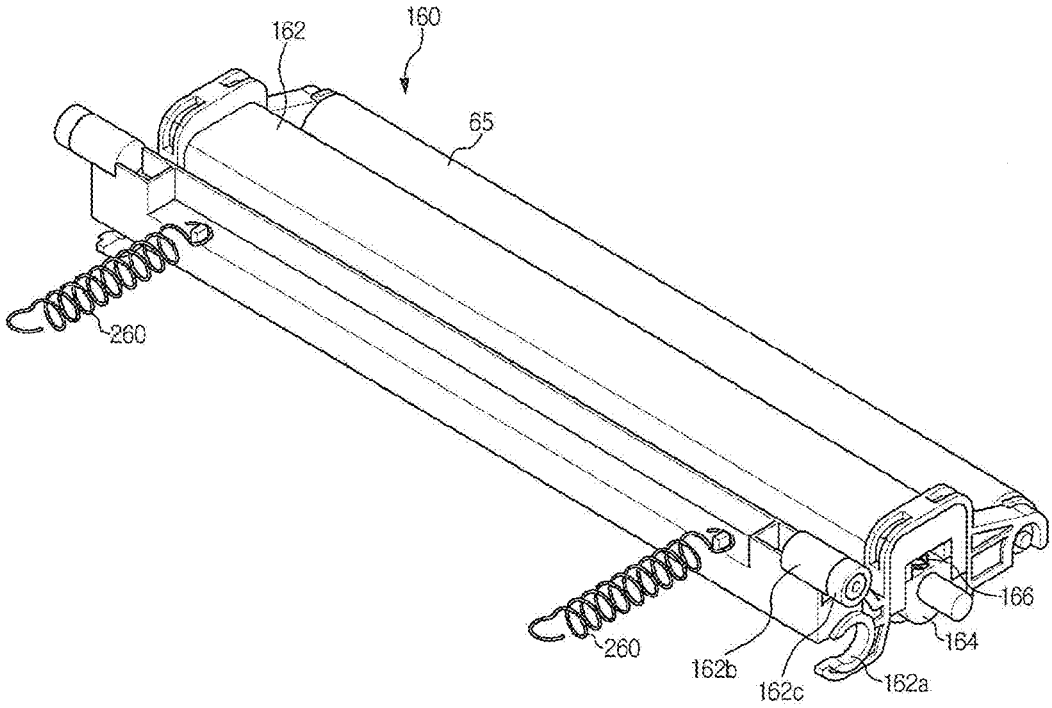
FIG. 5 is a perspective view illustrating a third transfer unit of the transfer device according to an embodiment.

FIG. 5, illustrates an embodiment of the third transfer unit 160 that can be employed in the transfer device 60 of FIG. 2.

Referring to FIGS. 2, 3 and 5, the third transfer unit 160 may include a third roller frame 162 configured to be rotatably coupled to the supporting frame 100, a third transfer roller 66Y mounted to the third roller frame 162, a holder 164 connected to either end of the third transfer roller 66Y, and an elastic member 166 configured to press the third transfer roller 66Y toward the third photosensitive body 40Y.

The third roller frame 162 may be perforated at opposite sides thereof with hinge holes 162*a*. The supporting frame 100 may accordingly be provided with a hinge shaft 102 configured to be engaged in the hinge holes 162*a* of the third roller frame 162.

First elastic units 260 may be provided to bias the third roller frame 162 in a direction of spacing the third transfer roller 66Y from the third photosensitive body 40Y. The first elastic units 260 may be tensile coil springs, for example. According to an embodiment, one end of each first elastic unit 260 may be supported by the third roller frame 162 while the other end of the first elastic unit 260 may be supported by the second roller frame 142.

The third roller frame 162 may further include interference arms 162*b* that may be positioned above the hinge holes 162*a*, each facing one end of the corresponding slider 200. When the sliders 200 slides to a position to interfere with the interference arms 162*b* of the third roller frame 162, the third roller frame 162 pivots about the hinge shaft 102, causing the third transfer roller 66Y to move toward the third photosensitive body 40Y. Thus, the third transfer roller 66Y can be made to elastically press the third photosensitive body 40Y with the transfer belt 61 interposed therebetween.

According to an embodiment, a rotator 162*c* may be provided at an end of the interference arm 162*b*. The rotator 162*c* may be configured to guide smooth rotation of the third roller frame 162 pressed by the sliders 200.

The tension roller 65 may be rotatably mounted to the third roller frame 162. As the third roller frame 162 is rotated about the hinge shaft 102, the tension roller 65 may be configured to press the inner peripheral surface of the transfer belt 61 or to release a force acting thereon.

As shown in FIGS. 2 through 4, each of the sliders 200 may be slideably mounted to the supporting frame 100. That is, the slider 200 may be configured to move linearly and reciprocally along the first direction A via operation of the drive unit 240, thereby enabling movement of the first transfer roller 66C, second transfer roller 66M and third roller frame 162. Guide rollers 202, configured to guide movement of the slider 200, may be arranged between the slider 200 and the supporting frame 100.

The slider 200 extends in the first direction A, one end thereof facing the third roller frame 162.

The lever 220C may be provided between the slider 200 and the first transfer roller 66C. The lever 220M may be provided between the slider 200 and the second transfer roller 66M. The levers 220C and 220M may be configured to respectively transmit the motional force of the slider 200 to the first transfer roller 66C and second transfer roller 66M, allowing the first transfer roller 66C and second transfer roller 66M to be moved in a second direction B. Although FIG. 4 illustrates only the lever 220C corresponding to the first transfer unit 120, it will be appreciated that the lever 220M corresponding to the second transfer unit 140 may have substantially the same or similar configuration.

In FIG. 4, details related to the lever 220C are illustrated. The lever 220C may include a shaft coupling hole 222, a first lever arm 224, and a second lever arm 228. A lever rotating shaft (not shown) provided at the supporting frame 100 may be coupled into the shaft coupling hole 222.

The first lever arm 224 may extend from the shaft coupling hole 222, and may include a coupling arm 226, provided at an end thereof. The coupling aim 226 may be arranged to come into an interfering contact with the slider 200. The coupling arm 226 may be, for example, inserted into a coupling recess 204 indented in the slider 200.

The holder 124 may include a holder arm 124*a* that protrudes toward the slider 200. The second lever arm 228 may extend from the shaft coupling hole 222, and may be located and positioned under the holder arm 124*a*.

With reference again to FIG. 2, details related to the slider 200 are illustrated. A cam receiving part 206 may be defined at an end of the slider 200 to receive a first cam 244 (described hereinafter). Sidewalls 206*a* and 206*b* may be provided at opposite sides of the cam receiving part 206. The sidewalls 206*a* and 206*b* may be pressed by the first cam 244 based on the rotating position of the first cam 244.

Figure 6:
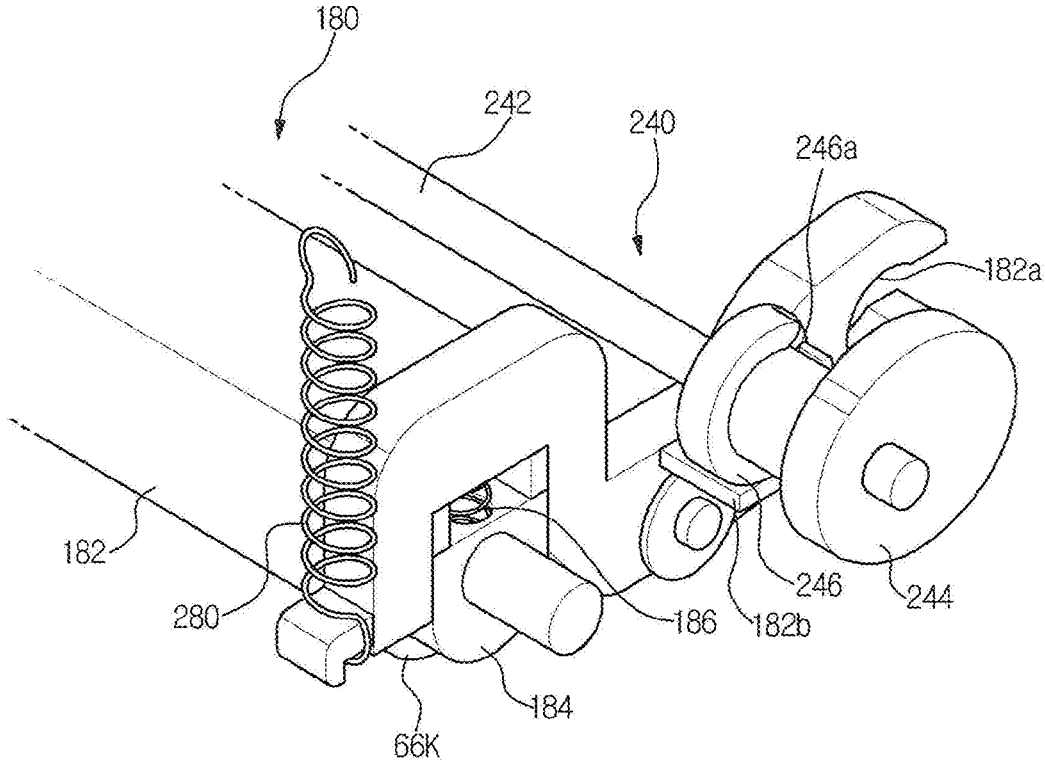
FIG. 6 is a perspective view illustrating a fourth transfer unit and a drive unit of the transfer device according to an embodiment.

FIG. 6 is a perspective view illustrating the fourth transfer unit 180 and the drive unit 240 of the transfer device 60 according to an embodiment.

As shown in FIGS. 2, 3 and 6, the fourth transfer unit 180 may include a fourth roller frame 182 configured to be rotatably coupled to the supporting frame 100, a fourth transfer roller 66K mounted to the fourth roller frame 182, a holder 184 coupled to an end of the fourth transfer roller 66K and an elastic member 186 configured to elastically bias the fourth transfer roller 66K toward the fourth photosensitive body 40K.

The fourth roller frame 182 may be, according to an embodiment, perforated at opposite sides thereof with hinge holes 182*a*, to which a hinge shaft 104 provided in the supporting frame 100 may be engaged.

Second elastic units 280 may be provided and configured to bias the fourth roller frame 182 in a direction that causes the fourth transfer roller 66K to be spaced apart from the fourth photosensitive body 40K. While only one second elastic unit 280 is depicted in FIG. 6, there may be provided two or greater number of elastic units 280. The second elastic units 280 may be tensile coil springs, for example. One end of each second elastic unit 280 may be supported by the fourth roller frame 182, while the other end of the second elastic unit 280 may be supported by the supporting frame 100.

The fourth roller frame 182 may include interference protuberances 182*b* positioned between the respective hinge holes 182*a* and the fourth transfer roller 66K. When each interference protuberance 182*b* is pressed by a second cam 246 (described hereinafter), the fourth roller frame 182 may rotate, causing the fourth transfer roller 66K to move toward the fourth photosensitive body 40K.

As shown in FIGS. 2 and 6, the drive unit 240 may include a rotating shaft 242 that may be configured to be rotatably mounted to the supporting frame 100. The first and second cams 244 and 246 may be connected to ends of the rotating shaft 242. The rotating shaft 242 and first and second cams 244 and 246 may be configured to rotate upon receiving power transmitted from a power source (not shown). In an embodiment, a pair of the first and second cams 244 and 246 may take the form of a single integrated member.

The first cam 244 may be located in the cam receiving part 206 of the slider 200, as shown in FIG. 2. The first cam 244 is configured to selectively press one of the sidewalls 206*a* and 206*b* based on a rotating position thereof, thereby allowing the slider 200 to move linearly along the first direction A.

The second cam 246 may be configured to press the interference protuberance 182*b* of the fourth roller frame 182, thereby initiating rotation of the fourth transfer unit 180. The second cam 246 may include a receiving recess 246*a* such that the interference protuberance 182*b* is able to be received in the receiving recess 246*a* based on the rotating position of the second cam 246. When the interference protuberance 182*b* is seated in the receiving recess 246*a*, the second cam 246 does not apply pressing force to the interference protuberance 182*b* of the fourth roller frame 182, allowing the fourth roller frame 182 to be returned to the original position by elastic force of the second elastic units 280.

Figure 7:
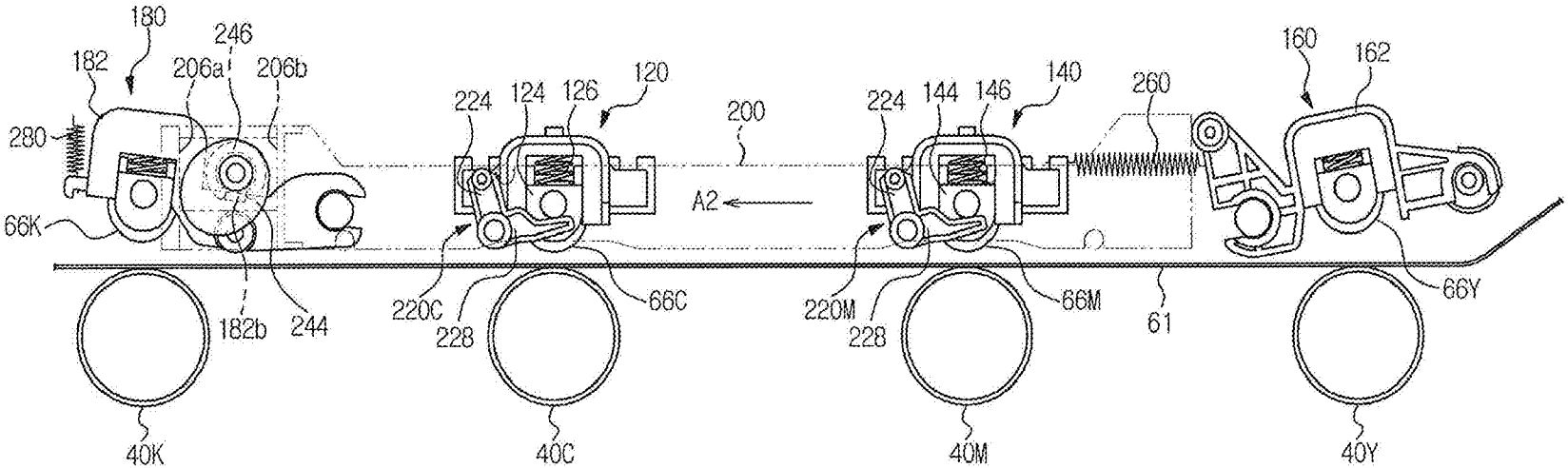
FIGS. 7 to 9 are views illustrating operation of the transfer device according to an embodiment.
Figure 8:
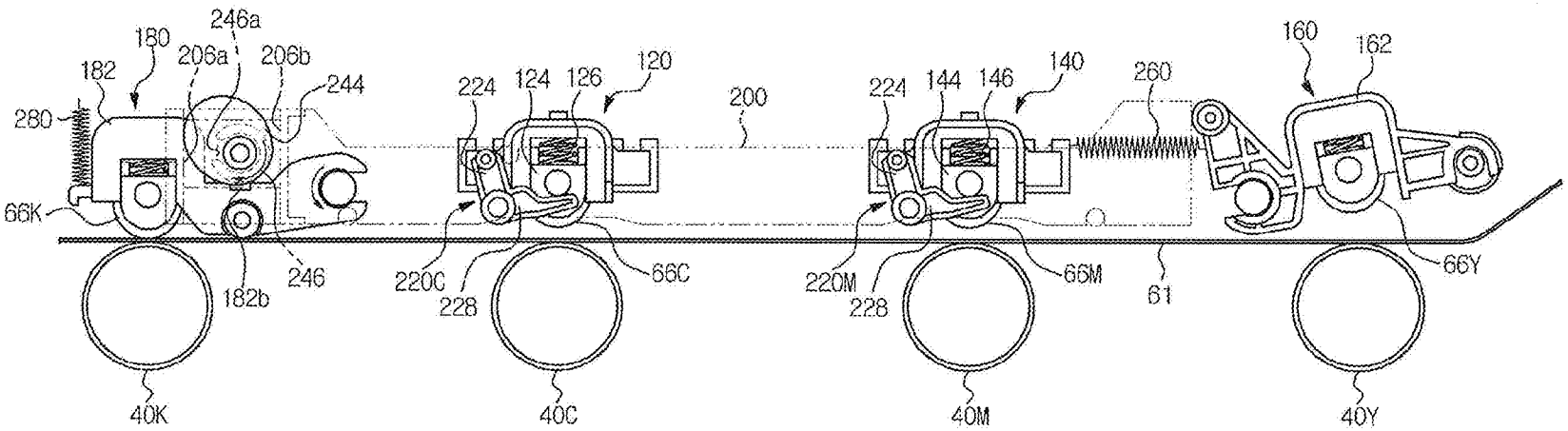
Figure 9:
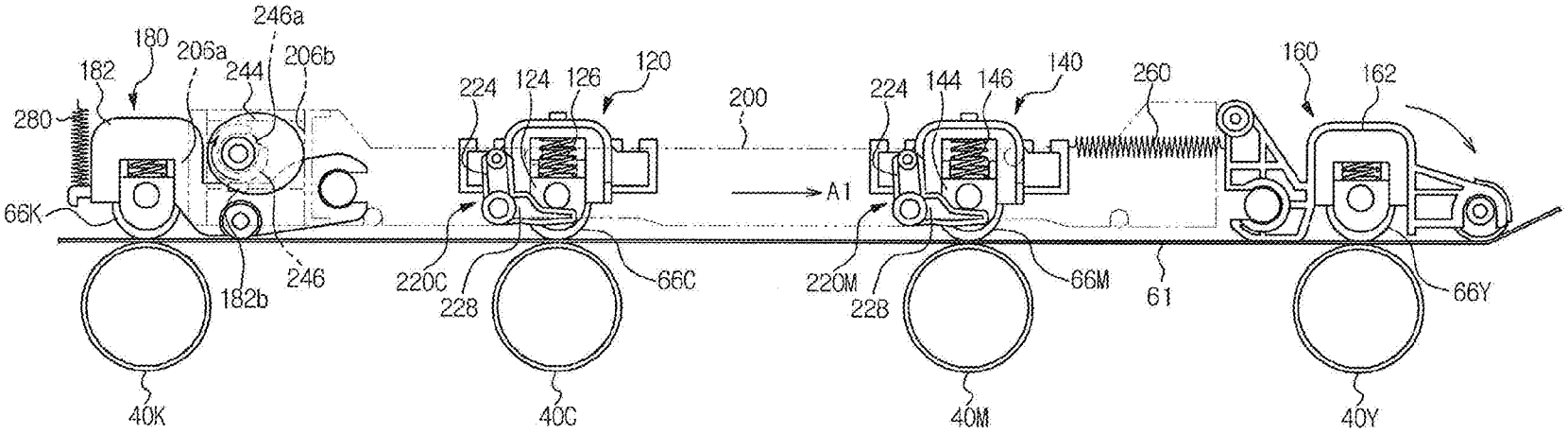

FIGS. 7 to 9 are views illustrating operation of the transfer device 60 according to an embodiment. FIG. 7 illustrates an initial mode of the image forming apparatus 1, FIG. 8 illustrates a black-and-white printing mode, and FIG. 9 illustrates a color printing mode.

Referring to FIG. 7, when the image forming apparatus 1 is in an initial mode, the first cam 244 presses the sidewall 206*a* of the slider 200. In this case, the second lever arms 228 of the levers 220C and 220M respectively support the holders 124 and 144 of the first transfer unit 120 and second transfer unit 140. Thus, the first transfer roller 66C and second transfer roller 66M are maintained at positions spaced apart from the first photosensitive body 40C and second photosensitive body 40M, respectively.

The third roller frame 162 of the third transfer unit 160 is also maintained in such a position that the third transfer roller 66Y is spaced apart from the third photosensitive body 40Y by elastic force of the first elastic units 260.

In a state as shown in FIG. 7, the interference protuberance 182*b* of the fourth roller frame 182 is received in the receiving recess 246*a* of the second cam 246. Accordingly, the fourth roller frame 182 of the fourth transfer unit 180 is maintained in such a position that the fourth transfer roller 66K is spaced apart from the fourth photosensitive body 40K by elastic force of the second elastic units 280.

As described above, in the initial mode of the image forming apparatus 1 according to an embodiment, the first to fourth transfer rollers 66C, 66M, 66Y and 66K are spaced apart from the corresponding photosensitive bodies 40C, 40M, 40Y and 40K.

Referring to FIG. 8, when the image forming apparatus 1 is in a black-and-white printing mode, the first cam 244 and second cam 246 are rotated clockwise by a predetermined angle from the state as shown in FIG. 7. In this case, since the first cam 244 continues to press the sidewall 206*a* of the slider 200, the slider 200 is maintained in the same state as shown in FIG. 7. Accordingly, the first to third transfer rollers 66C, 66M and 66Y remain spaced apart from the first to third photosensitive bodies 40C, 40M and 40Y, respectively.

However, in a state as shown in FIG. 8, the second cam 246 presses the interference protuberance 182*b* of the fourth roller frame 182. This causes counterclockwise rotation of the fourth roller frame 182, allowing the fourth transfer roller 66K to press the fourth photosensitive body 40K.

As described above, during the black-and-white printing mode of the image forming apparatus 1, only the fourth transfer roller 66K, which is required for a black-and-white printing operation according to an embodiment, is operated to press the fourth photosensitive body 40K.

Referring to FIG. 9, when the image forming apparatus 1 is in a color printing mode, the first cam 244 and second cam 246 are rotated by a predetermined angle from the state as shown in FIG. 8.

In this case, the first cam 244 presses the sidewall 206*b* of the slider 200, causing the slider 200 to linearly move in the direction A1. With the linear movement of the slider 200, the levers 220C and 220M, which are coupled to the slider 200 via the first lever arms 224, are rotated clockwise and thus the first transfer roller 66C and second transfer roller 66M are respectively moved toward the first photosensitive body 40C and second photosensitive body 40M by elastic force of the elastic members 126 and 146. The first transfer roller 66C and second transfer roller 66M thus respectively press the first photosensitive body 40C and second photosensitive body 40M.

Additionally, as the slider 200 is moved in the direction A1, the slider 200 pushes the third roller frame 162, causing clockwise rotation of the third roller frame 162. As a result, the third transfer roller 66Y is moved toward the third photosensitive body 40Y, thereby pressing the third photosensitive body 40Y.

When the slider 200 is moved in the direction A1 by rotation of the first cam 244, elastic force of the elastic members 126 and 146 is transmitted to the slider 200 via the levers 220C and 220M. The elastic force of the elastic members 126 and 146 acts to assist in the movement of the slider 200 in the direction A1. Accordingly, the slider 200 moves in the direction A1 under the influence of the elastic force of the elastic members 126 and 146. This consequently can reduce a torque required for rotation of the first cam 244.

When the second cam 246 is rotated from the state as shown in FIG. 8 to the state as shown in FIG. 9, the second cam 246 continues to press the interference protuberance 182*b* of the fourth roller frame 182. As a result, the fourth transfer roller 66K position is maintained to continuously press the fourth photosensitive body 40K.

As described above, during the color printing mode of the image forming apparatus 1, each of the first to fourth transfer rollers 66C, 66M, 66Y and 66K are configured to press the first to fourth photosensitive bodies 40C, 40M, 40Y and 40K.

To return the image forming apparatus 1 to the initial mode, the first cam 244 and second cam 246 may be rotated from the state as shown in FIG. 9 to the state as shown in FIG. 7. The slider 200 is moved in a direction A2 by rotation of the first cam 244, and thus, the first transfer roller 66C and second transfer roller 66M are respectively spaced apart from the first photosensitive body 40C and second photosensitive body 40M by the levers 220C and 220M.

To implement the above-described operation according to an embodiment, a force is required to deform the elastic members 126 and 146 that elastically support the first transfer roller 66C and second transfer roller 66M. To accomplish this, when the slider 200 is moved in the direction A2, the third roller frame 162 may apply a force to the slider 200 in the direction A2 while being returned to an original position by the first elastic units 260. Such a force applied to the slider 200 can reduce a torque required for rotation of the first cam 244.

In the above-described embodiment, the linearly movable slider 200 may experiences a slight difference in movement span between the first, second and third transfer rollers 66C, 66M and 66Y. Accordingly, when the first to third transfer rollers 66C, 66M and 66Y press the photosensitive bodies 40C, 40M and 40Y, there is no large difference in force acting between the transfer rollers 66C, 66M and 66Y and the photosensitive bodies 40C, 40M and 40Y. This may result in enhanced print quality.

Further, in the above-described embodiment, elastic force of the elastic members 126 and 146 and of the first elastic units 260 assists movement of the slider 200 based on a movement direction of the slider 200. This may reduce operating power of the slider 200.

As is apparent from the above description, according to various embodiments, a plurality of transfer rollers do not experience a large difference in movement span and can press photosensitive bodies with an even or near-even pressure. In addition, it is possible to move the transfer rollers with a low torque, resulting in a reduction in power consumption.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a plurality of photosensitive bodies;

a plurality of transfer units, each transfer unit including a transfer roller arranged to correspond to an associated one of the photosensitive bodies and an elastic member configured to press the transfer roller toward the corresponding photosensitive body;

a slider configured to linearly move in a first direction to separate at least one of the transfer rollers of the transfer units from the corresponding photosensitive body;

a drive unit configured to drive the slider; and wherein the plurality of transfer units comprises;

a first transfer unit and a second transfer unit arranged in the first direction, wherein the transfer rollers of the first transfer unit and second transfer unit are configured to move in a second direction based on the linear movement of the slider in the first direction; and a third transfer unit rotatably arranged adjacent a first end of the slider with respect to the first direction, the third transfer unit being configured to rotate based on movement of the slider.

2. The apparatus according to claim 1, further comprising an elastic unit configured to elastically bias the third transfer unit to separate the transfer roller of the third transfer unit from the corresponding photosensitive body.

3. The apparatus according to claim 2, wherein elastic force applied by the elastic member to the slider opposes a direction of elastic force applied by the elastic unit to the slider.

4. The apparatus according to claim 1, further comprising a first lever and a second lever, the first and second levers respectively arranged between the slider and the first transfer unit and between the slider and the second transfer unit, the first and second levers configured to convert the first directional movement of the slider into the second directional movement of the transfer rollers.

5. The apparatus according to claim 1, wherein the plurality of transfer units comprises a fourth transfer unit rotatably arranged at a second end opposite the first end of the slider with respect to the first direction.

6. The apparatus according to claim 5, wherein the drive unit comprises a rotating shaft, a first cam mounted to the rotating shaft and configured to press the slider to cause linear movement of the slider, and a second cam mounted to the rotating shaft and configured to press one side of the fourth transfer unit to cause rotation of the fourth transfer unit.

7. The apparatus according to claim 6, wherein the first cam and second cam are integrally formed.

8. An image forming apparatus for implementing a plurality of operating modes, comprising:

a plurality of photosensitive bodies;

a transfer belt configured to face the plurality of photosensitive bodies;

a plurality of transfer units, each transfer unit including a transfer roller arranged to support an inner peripheral surface of the transfer belt at a position corresponding to an associated one of the photosensitive bodies and an elastic member configured to press the transfer roller to the corresponding photosensitive body;

a slider configured to reciprocally move in a first direction;

a drive unit configured to drive the slider; and an elastic unit configured to elastically bias one of the plurality of transfer units to separate the transfer roller of the one of the plurality of transfer units from the corresponding photosensitive body, wherein, when the image forming apparatus is in a first operating mode, the slider is configured to separate at least one of the transfer rollers from the corresponding photosensitive body through linear movement of the transfer roller in a second direction, and wherein, when the image forming apparatus is in a second operating mode, the slider is configured to press one of the plurality of transfer units so that the transfer roller of the one of the plurality of transfer units presses the corresponding photosensitive body.

9. The apparatus according to claim 8, wherein elastic force applied by the elastic member to the slider opposes a direction of elastic force applied by the elastic unit to the slider.

10. The apparatus according to claim 8, wherein the elastic member comprises a compressible coil spring, and wherein the elastic unit comprises a tensile coil spring.

11. A transfer device mountable in an image forming apparatus having first to fourth photosensitive bodies, the transfer device comprising:

a supporting frame;

a transfer belt configured to transfer an image formed on at least one of the first to fourth photosensitive bodies to a printing medium;

a first transfer unit comprising a first roller frame supported by the supporting frame, a first transfer roller movably mounted to the first roller frame and an elastic member configured to press the first transfer roller toward the first photosensitive body;

a second transfer unit comprising a second roller frame supported by the supporting frame, a second transfer roller movably mounted to the second roller frame and an elastic member configured to press the second transfer roller toward the second photosensitive body;

a third transfer unit comprising a third roller frame rotatably mounted to the supporting frame and a third transfer roller mounted to the third roller frame to correspond to the third photosensitive body;

a slider mounted to the supporting frame configured to move in a linear direction and configured to move the first transfer roller, the second transfer roller, and the third roller; and a drive unit configured to drive the slider.

12. The device according to claim 11, further comprising an elastic unit configured to rotate the third roller frame to separate the third transfer roller from the third photosensitive body.

13. The device according to claim 12, further comprising levers arranged respectively between the slider and the first transfer roller and between the slider and the second transfer roller, the levers configured to move the first transfer roller and second transfer roller based on movement of the slider.

14. The device according to claim 13, wherein elastic force applied by the elastic member to the slider opposes a direction of elastic force applied by the elastic unit to the slider.

15. The device according to claim 14, further comprising a fourth transfer unit, the fourth transfer unit comprising a fourth roller frame rotatably mounted to the supporting frame and a fourth transfer roller mounted to the fourth roller flame to correspond to the fourth photosensitive body.

16. The device according to claim 15, wherein the drive unit comprises a rotating shaft, a first cam mounted to the rotating shaft configured to press the slider, and a second cam mounted to the rotating shaft configured to press the fourth roller frame.

17. The device according to claim 16, wherein the slider comprises a receiving part comprising a first sidewall and a second sidewall, wherein the first cam is positioned in the receiving part and is configured to selectively press one of the first or second sidewalls to provide linear movement of the slider.

18. The device according to claim 11, further comprising a guide roller provided between the slider and the supporting frame and configured to guide movement of the slider.

* * * * *